US010729231B2

(12) United States Patent
Diamond et al.

(10) Patent No.: US 10,729,231 B2
(45) Date of Patent: Aug. 4, 2020

(54) TEMPLATE FOR A TUFTED CURVED SURFACE

(71) Applicant: GlaxoSmithKline Consumer Healthcare (UK) IP Limited, Brentford, Middlesex (GB)

(72) Inventors: David Diamond, Cascais (PT); Jean Diamond, Cascais (PT)

(73) Assignee: GlaxoSmithKline Consumer Healthcare (UK) IP Limited, Brentford, Middlesex (GB)

( * ) Notice: Subject to any disclaimer, the term of this patent is extended or adjusted under 35 U.S.C. 154(b) by 84 days.

(21) Appl. No.: 16/072,195

(22) PCT Filed: Jan. 23, 2017

(86) PCT No.: PCT/EP2017/051330
§ 371 (c)(1),
(2) Date: Jul. 24, 2018

(87) PCT Pub. No.: WO2017/129524
PCT Pub. Date: Aug. 3, 2017

(65) Prior Publication Data

US 2019/0029407 A1 Jan. 31, 2019

(30) Foreign Application Priority Data

Jan. 25, 2016 (IE) ..... S2016/0033

(51) Int. Cl.
*A46B 9/02* (2006.01)
*A46B 9/04* (2006.01)

(52) U.S. Cl.
CPC ..... *A46B 9/026* (2013.01); *A46B 9/04* (2013.01); *A46B 2200/1066* (2013.01)

(58) Field of Classification Search
CPC .... A46B 9/026; A46B 9/04; A46B 2200/1066
See application file for complete search history.

(56) References Cited

U.S. PATENT DOCUMENTS

| | | | | |
|---|---|---|---|---|
| 2,317,110 | A | 4/1943 | Person | |
| 2,706,825 | A | 4/1955 | Blakeman | |
| 4,291,431 | A | 9/1981 | Lewis, Jr. | |
| 2010/0132140 | A1* | 6/2010 | Diamond | A61C 17/222 15/22.1 |
| 2013/0055515 | A1 | 3/2013 | Diamond et al. | |
| 2013/0326834 | A1 | 12/2013 | Vankov et al. | |
| 2014/0173839 | A1 | 6/2014 | Henderson | |
| 2015/0097309 | A1 | 4/2015 | Newman | |
| 2018/0078351 | A1* | 3/2018 | Diamond | A46B 9/026 |

* cited by examiner

*Primary Examiner* — Dung Van Nguyen
(74) *Attorney, Agent, or Firm* — Roshni A. Sitapara; Joshua C. Sanders

(57) ABSTRACT

The present invention provides a template for a tufted curved surface such as a hemispherical brush head for an electric toothbrush or the like, the template comprising a substrate having an upper surface adapted to carry one or more tufts of bristles such as to project outwardly from the upper surface, the substrate being shaped to be deformable between an expanded state in which the upper surface is substantially flat, and a collapsed state in which the upper surface is curved.

16 Claims, 2 Drawing Sheets

TEMPLATE FOR A TUFTED CURVED SURFACE

This application is a 371 of International Application No. PCT/EP2017/051330, filed Jan. 23, 2017, which claims the priority of IE S2016/0033 filed Jan. 25, 2016.

FIELD OF THE INVENTION

This invention relates to a template for forming a tufted curved surface, for example a tufted hemisphere, and in particular to a multi-limbed template adapted to be formed into a hemispherical brush head, most preferably a head for a toothbrush.

BACKGROUND OF THE INVENTION

Brushes and brush heads are used in an almost endless array of applications, ranging is size, shape, material, along with bristle size, shape and arrangement. One issue that arises in the manufacture and use of brush heads is the manner in which the bristles, which are normally arranged in tufts, are located and secured in the brush head. There are numerous ways to embed the tufts of bristles, which can vary depending on the type of material from which the bristles are made, the application to which the brush is to be employed, which may require a certain level of bristle retention, in addition to the size and/or shape constraints imposed by the brush head itself.

Bristle location and retention become increasing difficult as the size of the brush head reduces, due to a reduction in the overall material forming the head and which may be used to secure the bristles, in addition to a reduction in the amount of available surface area on the head from which the bristles may project. Finally, the shape of the head may impose further restrictions or difficulties in inserting and retaining the bristles. This is particularly relevant when seeking to produce a brush head whose surface, from which the tufts of bristles project, is curved, for example spherical or hemispherical.

It is therefore an object of the present invention to provide a template for a tufted curved surface such as a hemisphere, which template addresses some of the above issues.

SUMMARY OF THE INVENTION

According to a first aspect of the present invention there is provided a template for a tufted curved surface comprising a substrate having an upper surface adapted to carry one or more tufts of bristles such as to project outwardly from the upper surface; characterised in that the substrate is shaped to be deformable between an expanded state in which the upper surface is substantially flat, and a collapsed state in which the upper surface is curved.

Preferably, the substrate is shaped and dimensioned to define, when deformed into the collapsed state, a hemispherical upper surface.

Preferably, the substrate comprises a plurality of radially extending limbs at least some of which are adapted to carry one or more of the tufts of bristles.

Preferably, the substrate comprises a plurality of apertures through each of which a tuft of bristles passes to project from the upper surface.

Preferably, the apertures are arranged such that when the substrate is in the collapsed state the tufts of bristles are arranged in concentric rings.

Preferably, the substrate is shaped such that a free end of each limb is isolated from each adjacent free end when the substrate is in the expanded state, and abutting against each adjacent free end when in the collapsed state.

Preferably, the substrate is substantially star shaped when in the expanded state.

Preferably, each limb tapers outwardly toward the free end.

Preferably, the template comprises a backing provided on a lower surface of the substrate which is adapted, when the substrate is in the collapsed state, to define a support on which the substrate is carried.

Preferably, the backing is adapted to define a hemispherical support when the substrate is in the collapsed state.

Preferably, the backing is segmented in order to allow deformation of the substrate from the expanded to the collapsed state.

According to a second aspect of the present invention there is provided a method of forming a tufted curved surface, the method comprising the steps of providing a template comprising a substrate having an upper surface from which one or more tufts of bristles project; and deforming the substrate from an expanded state in which the upper surface is substantially flat to a collapsed state in which the upper surface is curved.

Preferably, the method comprises deforming the substrate into the collapsed state to define a hemispherical upper surface.

Preferably, the method comprises deforming the substrate onto a support.

Preferably, the method comprises deforming the substrate onto a hemispherical support.

Preferably, the method comprises forming the support integrally with a lower surface of the substrate.

According to a third aspect of the present invention there is provided a tufted brush head formed from the template according to the first aspect of the invention.

As used herein, the term "tufted" is intended to mean a surface or object which has one or more tufts of bristles or the like projecting outwardly from the surface, a brush head being an example of an object defining such a tufted surface.

BRIEF DESCRIPTION OF THE DRAWINGS

The present invention will now be described with reference to the accompanying drawings of a preferred embodiment, in which.

DETAILED DESCRIPTION OF THE DRAWINGS

Figure 1:
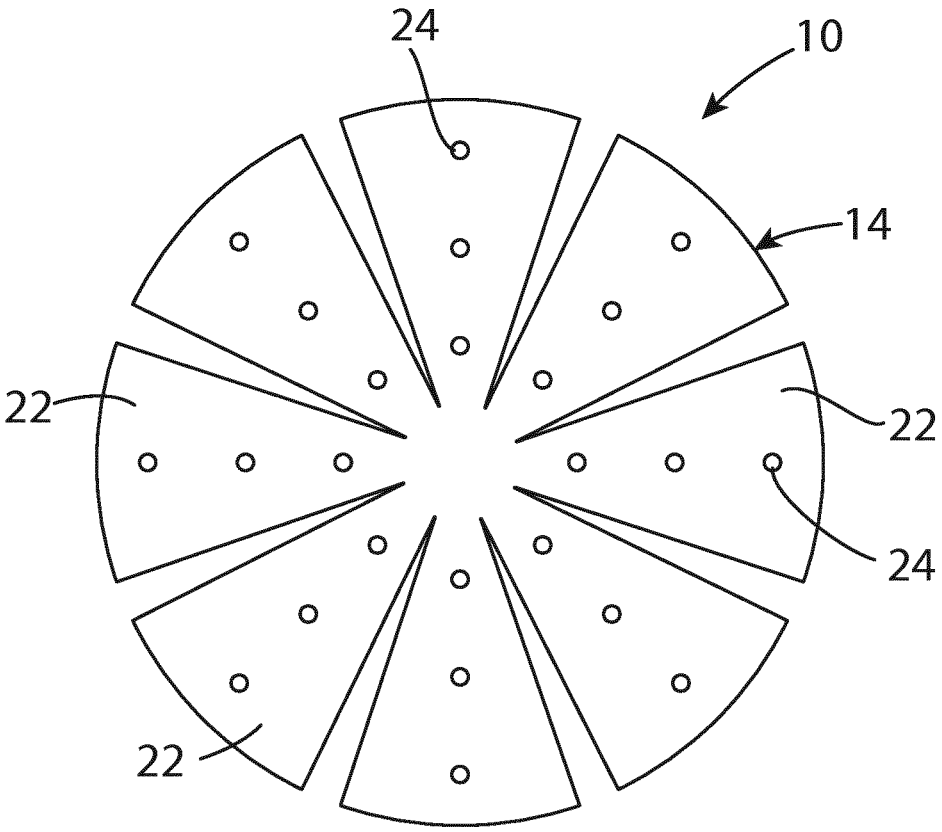
FIG. 1 illustrates a plan view of a template for a tufted curved surface such as a brush head according to an embodiment of the present invention, the template being in an expanded state with tufts of bristles being omitted for clarity.

Referring now to the accompanying drawings, there is illustrated a template (10) for forming a tufted curved surface such as a tufted hemisphere, in particular a hemispherical brush head (12), which may find use in any number of applications, in particular applications in which the brush head (12) is mechanically or otherwise rotated about one or more axes of the head (12) in order to effect a brushing motion, as for example in an electric toothbrush or the like. It will however be appreciated that the template (10) and accompanying method of the invention may be adapted to form a tufted curved surface such as a cylindrical surface or the like, the hemispherical brush head (120 being an exemplary embodiment of the invention.

The template (10) comprises a substrate (14) which may be formed from any suitable material, preferably a polymer or the like which is deformable as will be described hereinafter, the substrate (14) being adapted to carry an array of tufts (16) of individual bristles (18). The array of tufts (16) are arranged, when the template (10) is in a flattened or expanded state as illustrated for example in FIGS. 1 and 2, to project substantially normally from an upper surface (20) of the substrate (14) at the various sites about the substrate (14) at which the tufts (16) are secured.

The substrate (14) is divided into a circular array of segments or limbs (22) which radiate outwardly from the centre of the substrate (14), increasing in width towards a free or outer end thereof. In the flattened or expanded state illustrated in FIGS. 1 and 2 the substrate (14) is substantially circular in shape, being divided up into the plurality of segments (22). In the preferred embodiment illustrated each segment (22) is provided with a linear array of apertures (24) arranged radially adjacent one another, and preferably positioned along a centre line of each of the segments (22), in order to provide an even distribution of the tufts (16) in the finished brush head (12) as will be described hereinafter. It will however be appreciated that the tufts (16) and corresponding apertures (24) may be provided in any desired arrangement and/or density.

Figure 2:
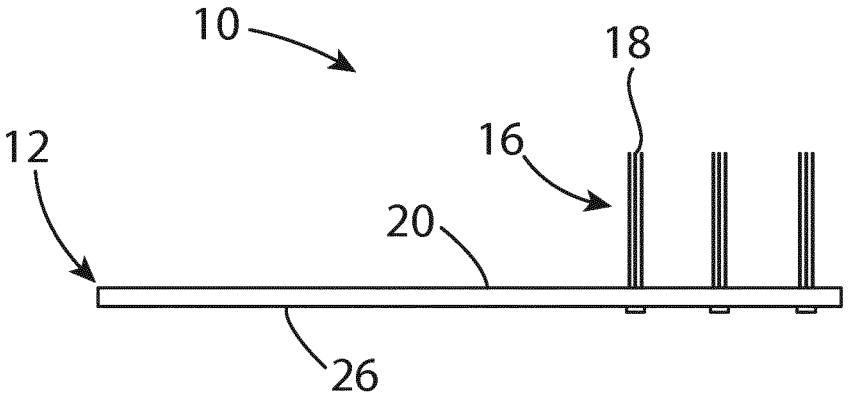
FIG. 2 illustrates a side elevation of the template shown in FIG. 1, in the expanded state and with the tufts of bristles shown.

In use each tuft (16) is passed through the corresponding aperture (24) from a lower surface (26) of the substrate (14), to project upwardly from the upper surface (20) as illustrated in FIG. 2. The tufts (16) may be glued or otherwise adhered in position as illustrated in FIG. 2, although any other suitable means of securing the tuft (16) in position may be employed, for example by melting the substrate (14) locally about each aperture (24) and/or by melting that segment of the tuft (16) located in the aperture (24). Each tuft (16) may be inserted into a respective aperture (24) and the excess length projecting from the lower surface (26) removed by using a heating blade or the like (not shown), which will serve the dual purposed of trimming the excess length from the tufts (16) while also locally melting or partially melting the bristles (18) forming the tuft (16) in order to adhere the tuft (16) in position.

Figure 3:
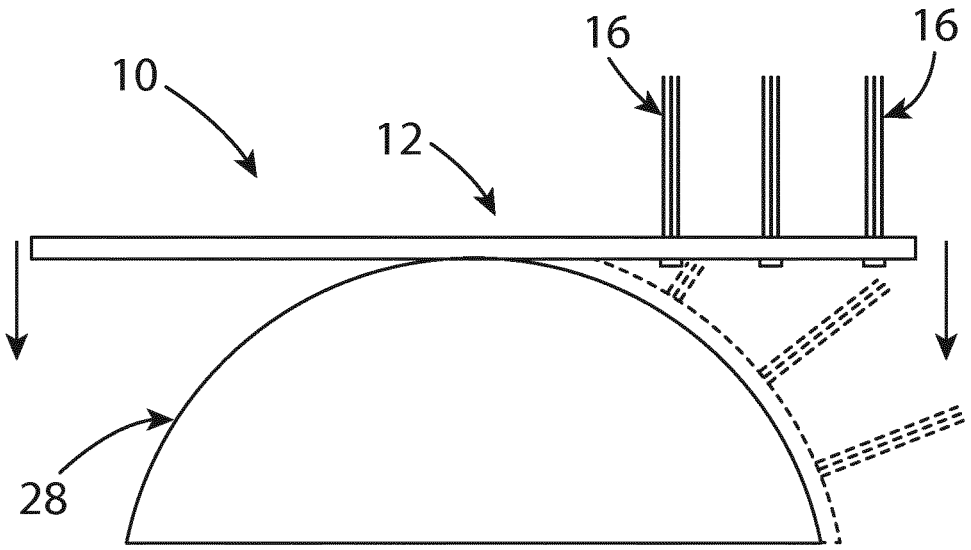
FIG. 3 illustrates the template of FIG. 1 positioned on a form onto which the template is deformed into a collapsed state having a substantially hemispherical shape.
Figure 4:
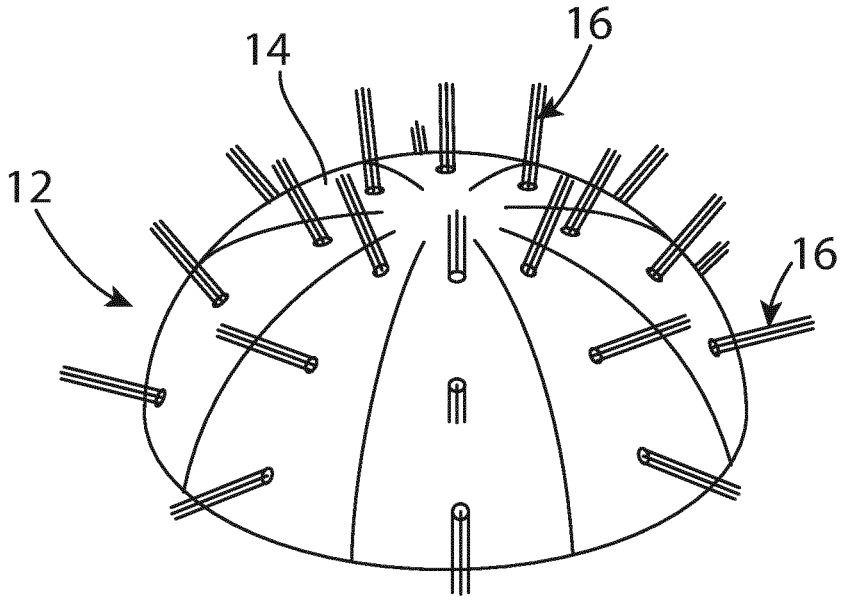
FIG. 4 illustrates a hemispherical tufted brush head formed from the template illustrated in FIGS. 1 and 2.

Once a tuft (16) has been secured in each of the apertures (24) the template (10) comprising the substrate (14) and tufts (16) is then ready to be formed into the brush head (12) as illustrated in FIG. 4. In a preferred embodiment the template (10), in the flattened or expanded state as illustrated in FIGS. 1 and 2, is located above a hemispherical form or support (28) as illustrated in FIG. 3. Each of the segments (22) is then deformed downwardly into contact with the surface of the hemispherical support (28), the shape of the substrate (14), in particular each of the individual segments (22), being such that when deformed downwardly onto the support (28) the substrate (14) fully covers the support (28) such as to form a hemispherical layer about the support (28), from which the tufts (16) project in an orientation substantially normal to the surface.

The substrate (14) may be glued or otherwise adhered in place on the support (28) in order to form the finished brush head (12). In such an embodiment the support (28) then becomes an integral component of the finished brush head (12). The support (28) will also serve to trap the inner ends of each of the tufts (16) between the lower surface (26) of the substrate (14) and the outer surface of the support (28), thereby securely retaining the tufts (16) in position.

However, as an alternative, the support (28) may be omitted, and a deformable backing (not shown) provided on or formed integrally with the lower surface (26), the backing (not shown) being shaped and dimensioned such that when the substrate (14) is deformed into the collapsed or spherical shape the backing (not shown) will take the form of a substantially solid hemispherical base of the brush head (12), effectively equivalent to the support (28). The backing may also be adapted to define, when the substrate (14) has been deformed into the collapsed state, one or more features on the underside of the brush head (12), for example a shaft (not shown) to form an axle by which the brush head (12) may be mounted to a support or opposed hemispherical brush head in order to form a complete hemispherical brush head (not shown). The backing may also define other features such as a gear wheel (not shown) by which, in use, the brush head (12) may be driven.

In order to facilitate the downward deformation of the array of segments (22) the substrate (14) may comprise one or more tabs (not shown) projecting from a free end of each of the segments (22), which tab (not shown) may then be used to manually or mechanically draw the respective segment (22) downwardly into contact with the outer surface of the support (28). Once the substrate (14) has been glued or otherwise secured to the support (28) the tabs (not shown) may then be removed, and may thus have a frangible connection to the respective segment (22).

It is also envisaged that the template (10) may be designed to be deformable into a complete sphere (not shown) having a tufted outer surface. Such a ball like brush head could be used in a wide range of applications, for example an electric toothbrush in which the head may be driven in a number of directions to achieve desired brushing techniques.

It will thus be appreciated that the template (10) of the present invention allows for the relatively complex tufted curved surface to be formed, in particular allowing a hemispherical head (12) to be formed from a flattened template (10) to which the array of tufts (16) can be easily secured prior to forming the hemispherical final form.

The invention claimed is:

1. A template for a tufted curved surface comprising a substrate having an upper surface adapted to carry one or more tufts of bristles such as to project outwardly from the upper surface; characterised in that the substrate is shaped to be deformable between an expanded state in which the upper surface is substantially flat, and a collapsed state in which the upper surface is curved, wherein the substrate comprises a plurality of radially extending limbs at least some of which are adapted to carry one or more of the tufts of bristles.

2. A template according to claim 1 in which the substrate is shaped and dimensioned to define, when deformed into the collapsed state, a hemispherical upper surface.

3. A template according to claim 1 in which the substrate comprises a plurality of apertures through each of which a tuft of bristles passes to project from the upper surface.

4. A template according to claim 3 in which the apertures are arranged such that when the substrate is in the collapsed state the tufts of bristles are arranged in concentric rings.

5. A template according to claim 1 in which the substrate is shaped such that a free end of each limb is isolated from each adjacent free end when the substrate is in the expanded state, and abutting against each adjacent free end when in the collapsed state.

6. A template according to claim 1 in which the substrate is substantially star shaped when in the expanded state.

7. A template according to claim 1 in which each limb tapers outwardly toward the free end.

8. A template according to claim 1 comprising a backing provided on a lower surface of the substrate which is adapted, when the substrate is in the collapsed state, to define a support on which the substrate is carried.

9. A template according to claim 8 in which the backing is adapted to define a hemispherical support when the substrate is in the collapsed state.

10. A template according to claim 8 in which the backing is segmented in order to allow deformation of the substrate from the expanded to the collapsed state.

11. A method of forming a tufted curved surface, the method comprising the steps of providing a template comprising a substrate according to claim 1; and deforming the substrate from an expanded state in which the upper surface is substantially flat to a collapsed state in which the upper surface is curved.

12. The method of claim 11 comprising deforming the substrate into the collapsed state to define a hemispherical upper surface.

13. The method of claim 11 comprising deforming the substrate onto a support.

14. The method of claim 13 comprising deforming the substrate onto a hemispherical support.

15. The method of claim 13 comprises forming the support integrally with a lower surface of the substrate.

16. A tufted brush head formed from the template according to claim 11.

* * * * *